US007654639B2

(12) United States Patent
Park et al.

(10) Patent No.: US 7,654,639 B2
(45) Date of Patent: Feb. 2, 2010

(54) INK JET PRINTER AND PRINT HEAD DEVICE THEREOF

(75) Inventors: Jeong-yeon Park, Ansan-si (KR); Sang-cheol Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 516 days.

(21) Appl. No.: 11/418,184

(22) Filed: May 5, 2006

(65) Prior Publication Data

US 2006/0250457 A1 Nov. 9, 2006

(30) Foreign Application Priority Data

May 9, 2005 (KR) ..... 10-2005-0038419

(51) Int. Cl.
*B41J 2/14* (2006.01)
*B41J 2/16* (2006.01)

(52) U.S. Cl. ..... 347/50; 347/88; 347/99

(58) Field of Classification Search ..... 347/50, 347/88, 99

See application file for complete search history.

(56) References Cited

U.S. PATENT DOCUMENTS

| | | | | |
|---|---|---|---|---|
| 4,791,439 | A | 12/1988 | Guiles | |
| 5,621,444 | A | 4/1997 | Beeson | |
| 5,910,810 | A * | 6/1999 | Brooks et al. | 347/88 |
| 6,003,971 | A | 12/1999 | Hanks et al. | |
| 6,170,942 | B1 * | 1/2001 | Ogawa et al. | 347/88 |

FOREIGN PATENT DOCUMENTS

| | | |
|---|---|---|
| JP | 3-166955 | 4/1991 |
| JP | 05-261914 | 10/1993 |
| JP | 7-32719 | 2/1995 |
| KR | 2001-17490 | 3/2001 |

OTHER PUBLICATIONS

Office Action issued in Korean Patent Application No. 2005-38419 on Apr. 28, 2006.

* cited by examiner

*Primary Examiner*—Thinh H Nguyen
(74) *Attorney, Agent, or Firm*—Stein McEwen, LLP

(57) ABSTRACT

An ink jet printer having a print head unit on which ink ejecting nozzles are arranged. The ink jet printer includes an ink supplying unit having a solid ink storage unit to store solid ink, and a heating unit to melt the solid ink into liquid ink, an ink reservoir to accommodate and store the liquid ink from the ink supplying unit, which is extended so as to correspond to the length of the print head unit, and a heater to heat the liquid ink, disposed in the lengthwise direction of the ink reservoir.

17 Claims, 2 Drawing Sheets

INK JET PRINTER AND PRINT HEAD DEVICE THEREOF

CROSS-REFERENCE TO RELATED APPLICATION

This application claims the benefit of Korean Application No. 2005-0038419, filed May 9, 2005, in the Korean Intellectual Property Office, the disclosure of which is incorporated herein by reference.

BACKGROUND OF THE INVENTION

1. Field of the Invention

An aspect of the present invention relates to an ink jet printer having an improved arrangement of a heater to prevent liquid ink from being solidified.

2. Description of the Related Art

Generally, an ink jet printer is inexpensive, is capable of high-performance printing, and is also advantageous in forming color images. In this respect, the ink jet printer has been widely used. The ink jet printer has a print head device formed with a multiplicity of fine nozzles through which ink is ejected toward paper to form images on the paper.

Generally, there are two kinds of ink jet printers: a liquid ink jet printer and a solid ink jet printer. The liquid ink jet printer stores ink in a liquid state and supplies liquid ink to a print head device, whereas the solid ink jet printer stores ink in a solid state, liquefies solid ink by necessary amounts and supplies the liquefied ink to the print head device. The solid ink jet printer uses solid ink that is mainly made of paraffin, which produces excellent glazed images, has good color sense and a cubic effect; further, generation of waste ink may be reduced. For this reason, the solid ink jet printer is widely used.

FIG. 1 schematically illustrates a conventional ink jet printer. As illustrated, an ink jet printer 100 comprises an ink reservoir 110 and heaters 130 to liquefy remaining ink.

The ink reservoir 110 stores liquid ink produced by heating and melting solid ink that is stored in an ink supplying unit (not shown). An ink accommodating unit 140 accommodates liquid ink from the ink supplying unit (not shown), and an ink passage 145 provides communication between the ink accommodating unit 140 and the ink reservoir 110, to thereby allow liquid ink accommodated in the ink accommodating unit 140 to flow into the ink reservoir 110.

The ink reservoir 110 comprises a supplying pipe 150 to supply ink to a print head 120. The print head 120 receives ink from the ink reservoir 110 through the ink supplying pipe 150, and ejects them onto paper.

The heaters 130 heat liquid ink that is stored in the ink reservoir 110 so as to prevent them from being solidified until they are supplied to the print head 120 through the ink supplying pipe 150. The heaters 130 are supported by an insertion hole 135 formed in a direction that is perpendicular to the lengthwise direction of the ink reservoir 110. This construction of the conventional ink jet printer is disclosed in U.S. Pat. No. 6,003,971.

Usually, a heat transmission rate of the heater 130 depends on a distance between the heater 130 and the liquid ink; that is, the closer the heaters 130 and the liquid ink are to each other, the higher the heat transmission rate between them is. However, as noted above, in the conventional ink jet printer 100, the heaters 130 are arranged in directions that are perpendicular to the lengthwise direction of the ink reservoir 110. Thus, the rate of heat transmission to the liquid ink stored within the ink reservoir 110 is degraded. In other words, since the liquid ink is disposed along the lengthwise direction of the ink reservoir 110 and adapt to the shape of the ink reservoir 110, and since the heaters 130 are arranged perpendicular to the lengthwise direction of the ink reservoir 110, thus, an average separation between the heaters 130 and the liquid ink is distant.

Because of this distant arrangement, only a portion of the liquid ink disposed for the length of the ink reservoir 110 may be heated by the heater 130, thereby degrading the heating rate of the heater 130 to heat liquid ink. In addition, to heat liquid ink stored for the whole length of the ink reservoir 110, a plurality of heaters 130 need to be disposed along the lengthwise direction of the ink reservoir 110.

SUMMARY OF THE INVENTION

Accordingly, an aspect of the present invention provides an ink jet printer and a print head device thereof, capable of efficiently heating liquid ink.

According to an aspect of the present invention, there is provided an ink jet printer having a print head unit on which ink jet nozzles are arranged, comprising an ink supplying unit having a solid ink storage unit to store solid ink, and a heating unit to melt the solid ink into liquid ink, an ink reservoir to accommodate and store the liquid ink from the ink supplying unit, which is extended so as to correspond to the length of the print head unit, and a heater to heat the liquid ink, disposed in the lengthwise direction of the ink reservoir.

The ink reservoir may comprise a plurality of section units to respectively store predetermined colors of ink therein, the heater being disposed between the section units.

The ink jet printer may further comprise a frame unit to support the ink reservoir, the frame unit having a heater supporting hole to accommodate and support the heater, which is extended in a lengthwise direction of the ink reservoir between the section units, wherein a length of the heater supporting hole is substantially equivalent to the whole length of the ink reservoir.

According to another aspect of the present invention, there is provided an ink jet print head device, comprising a print head unit on which ink ejecting nozzles are arranged, an ink reservoir to store liquid ink therein, which is extended so as to correspond to the length of the print head unit, and a heater to heat the liquid ink, which are disposed in the lengthwise direction on the ink reservoir.

The ink reservoir may comprise a plurality of section units to respectively store predetermined colors of ink therein, the heater being disposed between the section units.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
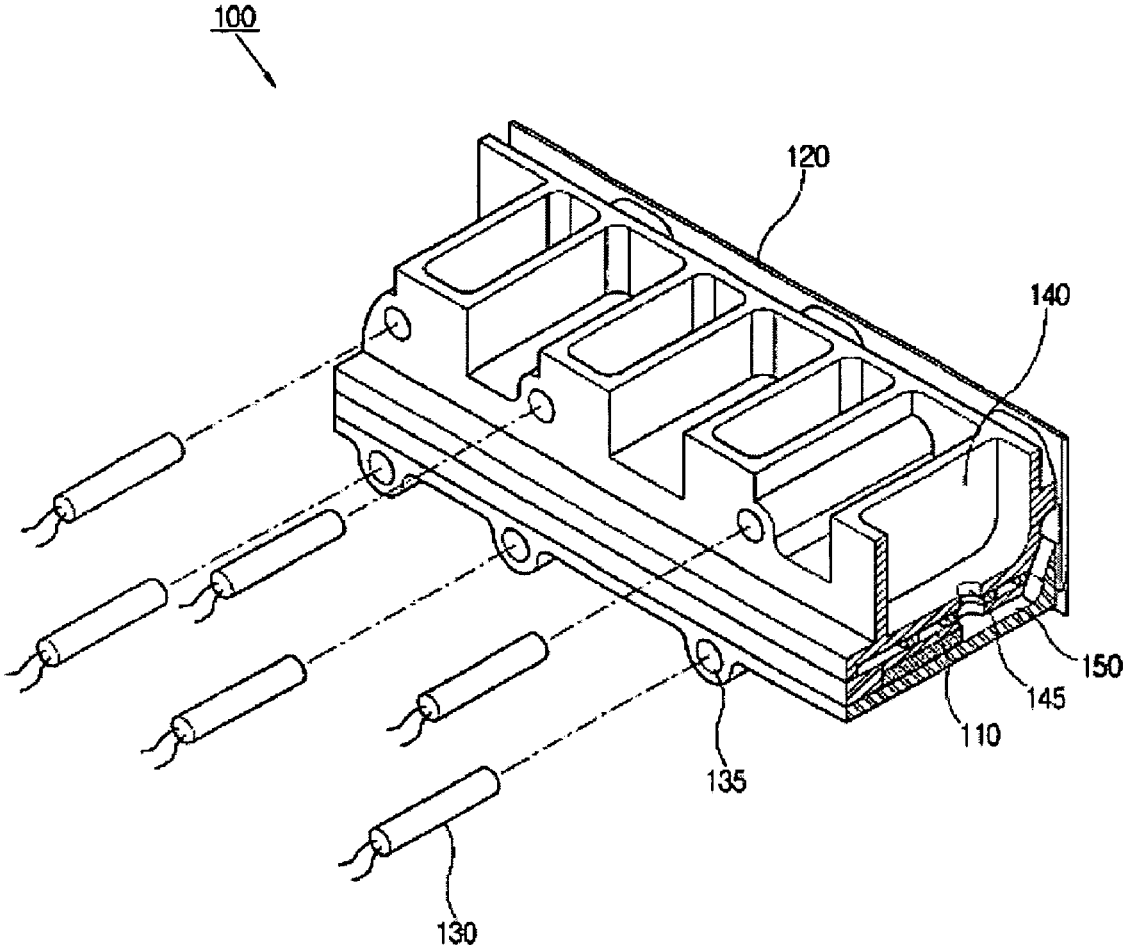
FIG. 1 (PRIOR ART)
FIG. 1 schematically illustrates a conventional ink jet printer.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
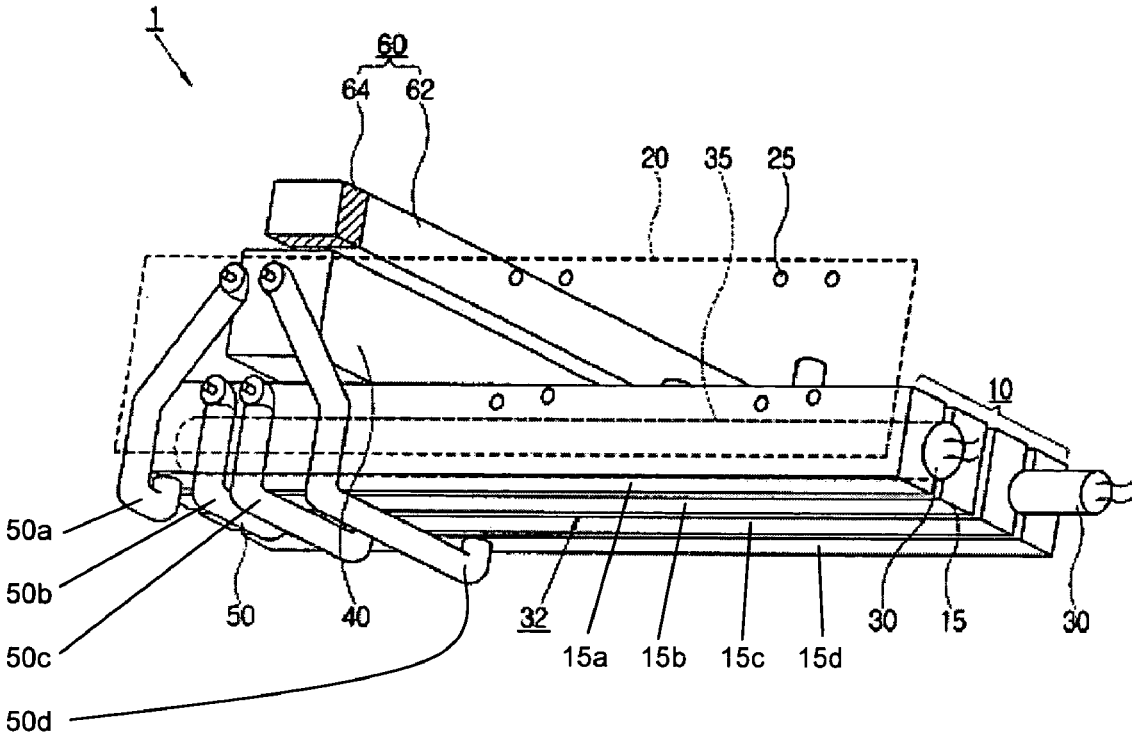
FIG. 2 schematically illustrates an ink jet printer according to an exemplary embodiment of the present invention.

FIG. 2 schematically illustrates an ink jet printer according to an exemplary embodiment of the present invention. As illustrated, an ink jet printer 1 comprises a print head unit 20 in which a multiplicity of ink ejecting nozzles (not shown) are arranged. The print head unit 20 receives external information about predetermined original images, and ejects ink through the ink ejecting nozzles (not shown). Thus, images are formed on printing paper.

The printing paper has a predetermined width, and the print head unit 20 extends along a length equivalent to the width of the printing paper. The ink ejecting nozzles (not shown) may be arranged in the print head unit 20 to face the entire width of the printing paper. The ink ejecting nozzles (not shown) may be arranged in plural arrays, such that the plural arrays of nozzles may respectively eject ink of varying predetermined colors. Alternately, the ink ejecting nozzles (not shown) respectively ejecting different colors may be densely arranged so as to form a group of nozzles. Plural groups of nozzles may then be arranged in the print head unit 20.

Ink inserting orifices 25 are arranged in the print head unit 20 along a lengthwise direction of the print head unit 20, through which ink from the ink reservoir 10 is supplied. Fine ink passages (not shown) communicate the ink inserting orifices 25 with the ink ejecting nozzles (not shown), thereby allowing ink to be supplied into the ink ejecting nozzles (not shown).

The ink jet printer 1 comprises an ink supplying unit 60 positioned on the top of the ink accommodating unit 40. The ink supplying unit 60 comprises a solid ink storage unit 62 to store solid ink therein, and a heating unit 64 to melt the solid ink into liquid ink. Solid ink is in a solid state at the normal temperature but is liquefied when heated over a predetermined melting point. The heating unit 64 heats a part of the solid ink over the predetermined melting point to melt the ink. The melted ink then flows into the ink accommodating unit 40 via a first ink passage (not shown).

The ink supplying unit 60 may comprise a solid ink storage unit 62 to store a monochromatic solid ink therein, or a plurality of solid ink storage units 62 to respectively store the colored ink, such as cyan, magenta, yellow and black ink, therein.

The ink accommodating unit 40 communicates with the ink reservoir 10 via a second ink passage (not shown). Thus, liquid ink flows into the ink accommodating unit 40 from the ink supplying unit 60 via the first ink passage and then flows into the ink reservoir 10 via the second ink passage.

The ink reservoir 10 accommodates and stores liquid ink from the ink supplying unit 60. The ink reservoir 10 may be extended so as to correspond to the length of the print head unit 20. Alternatively, the ink reservoir 10 may be extended so as to correspond to a part of the length of the print head unit 20, or to the whole length of the print head unit 20.

Where the ink supplying unit supplies the melted monochromatic ink, the ink reservoir 10 comprises a section unit 15 to store the melted monochromatic ink. Alternately, where the ink reservoir 10 supplies the melted colored ink, the ink reservoir 10 comprises a plurality of section units 15*a*, 15*b*, 15*c* and 15*d* to respectively store liquid colored ink therein. Where the ink reservoir comprises the plurality of section units 15*a*-15*d*, the ink accommodating unit 40 and the first and second ink passages (not shown) may be accordingly sectioned so as to receive and transfer liquid cyan, magenta, yellow and black ink.

The ink reservoir 10 is arranged substantially in parallel with the print head unit 20. The ink supplying pipe 50 (or, alternatively, ink supplying pipes 50*a*, 50*b*, 50*c*, and 50*d* for use with section units 15*a*, 15*b*, 15*c* and 15*d*, respectively) allows for communication between the ink reservoir 10 and the ink insertion orifices 25 of the print head unit 20, whereby the liquid ink stored internally in the ink reservoir 10 is supplied to the print head unit 20. Where the ink supplying pipe 50 is plural in number, the ink supplying pipes 15*a*-15*d* are arranged at a predetermined interval along the lengthwise direction of the ink reservoir 10, thereby efficiently supplying liquid ink to substantially all of the ink ejecting nozzles (not shown) of the print head unit 20.

A heater 30 is disposed along the lengthwise direction of the ink reservoir 10 to heat the liquid ink. Therefore, as the temperature surrounding the ink reservoir 10 drops below the predetermined melting point, the liquid ink stored in the ink reservoir 10 may be prevented from solidifying as time progresses due to the heat provided by the heater 30. Thus, the heater 30 serves to maintain the temperature of the liquid ink over the predetermined melting point thereof so that the liquid ink stored in the ink reservoir 10 does not solidify at least until after the liquid ink is supplied to the print head unit 20.

The heater 30 is disposed in the ink reservoir 10 along an extended direction of the ink reservoir 10. Since the ink reservoir 10 extends substantially linearly so as to correspond to the length of the print head unit 20, the liquid ink stored internally in the ink reservoir 10 is also disposed to extend substantially linearly in the lengthwise direction of the ink reservoir 10 and to adapt to the shape of the ink reservoir 10. As a result of this arrangement, heat transmission rates of the heaters 30 increases as the distance between the heater 30 and the liquid ink decreases. In fact, according to an embodiment of the invention, since the heater 30 is disposed so as to remain close to the liquid ink, the average separation between the heater 30 and the liquid ink may be reduced to a minimum. Therefore, the heat transmission rate of the heater 30 to the liquid ink may be optimized.

The heater 30 may also be disposed as extended along a partial length of the ink reservoir 10. In an embodiment of the invention, the heater 30 may extend along the whole length of the ink reservoir 10. Accordingly, substantially all of the liquid ink stored in the ink reservoir 10 may be efficiently heated. Also, an occurrence of an insufficient heating of the liquid ink positioned at ends of the ink reservoir 10 may be prevented.

According to an embodiment of the invention, the heater 30 may be disposed proximate to any position of the ink reservoir 10, that is, on the bottom side, the top side or the lateral side of the ink reservoir 10 as long as the heater 30 is disposed along the lengthwise direction of the ink reservoir 10. However, in an embodiment of the invention, the heater 30 is positioned in the middle of the reservoir 10, i.e., interposed between the section units 15. Accordingly, a distance between the liquid ink stored in the ink reservoir 10 and the heater 30 may be minimized. The heater 30 may be disposed in singular or in plural.

The ink reservoir 10 is supported by a frame unit 32, and the frame unit 32 may comprise a heater supporting hole 35. The heater supporting hole 35 is positioned between the section units 15, and is extended in the lengthwise direction to be substantially equivalent to the whole length of the ink reservoir 10. The heater 30 is inserted into and supported by the heater supporting hole 35, thereby being disposed in the lengthwise direction of the ink reservoir 10. In alternate embodiments, the heater 30 may be supported by a variety of devices, such as screws, adhesives, etc., each of which supports the heater 30 in the lengthwise direction of the ink reservoir 10.

Hereinafter, an ink jet print head device according to an exemplary embodiment of the present invention will be described with reference to FIG. 2. As illustrated, the ink jet print head device comprises a print head unit 20, an ink reservoir 10 and a heater 30.

Ink ejecting nozzles (not shown) adapted to a length that is substantially equivalent to a width of a sheet of printing paper having a predetermined size are arranged on the print head unit 20. The ink reservoir 10 stores liquid ink received from an ink supplying unit (not shown), and is extended so as to correspond to the length of the print head unit 20. The heater 30 is disposed in the lengthwise direction of the ink reservoir, heating the liquid ink.

The ink reservoir 10 comprises the plurality of section units 15*a*, 15*b*, 15*c* and 15*d* respectively storing predetermined colors of the liquid ink therein, and the heater 30 (or the plurality of heaters 30, where there is more than one heater 30) is (or are) disposed between the section units 15. Accordingly, since the average separation between the heater 30 and the liquid ink is minimized, a liquid ink heating efficiency of the heater 30 may be enhanced.

The ink jet printer according to the present invention may be a printer dedicated only for printing or a complex machine available for printing, copying and scanning together.

As is described above, an ink jet printer and a print head device thereof according to aspects of the present invention are capable of efficiently heating liquid ink by disposing a heater in the lengthwise direction of an ink reservoir so as to reduce the separate distance from liquid ink stored in the ink reservoir. Further, the number of heaters disposed may be reduced.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An ink jet printer having a print head unit on which ink jet nozzles are arranged, comprising:

an ink supplying unit having a solid ink storage unit to store solid ink, and a heating unit to melt the solid ink into liquid ink;

an ink reservoir, having a width and a length, to accommodate and store the liquid ink from the ink supplying unit, which extends so as to correspond to the length of the print head unit; and a heater to heat the liquid ink, the heater extending in the lengthwise direction of the ink reservoir, wherein the ink reservoir comprises a plurality of section units to respectively store predetermined colors of ink therein, the heater being disposed between the section units.

2. The ink jet printer of claim 1, further comprising a frame unit to support the ink reservoir, the frame unit having a heater supporting hole to accommodate and support the heater extending in the lengthwise direction of the ink reservoir between the section units, wherein a length of the heater supporting hole is substantially equivalent to the length of the ink reservoir.

3. An ink jet print head device, comprising:

a print head unit on which ink ejecting nozzles are arranged;

an ink reservoir, having a width and a length, to store liquid ink therein, which extends so as to correspond to the length of the print head unit; and a heater to heat the liquid ink, the heater extending in the lengthwise direction on the ink reservoir, wherein the ink reservoir comprises a plurality of section units to respectively store predetermined colors of ink therein, the heater being disposed between the section units.

4. A printer having a print head, comprising:

an ink reservoir, having a width and a length, to store liquid ink, the ink reservoir having a length corresponding to a length of the print head so as to provide the liquid ink to the print head along the entire length of the print head; and a heater to maintain a substantially uniform temperature of the liquid ink above a melting point thereof along substantially the entire length of the ink reservoir, wherein the heater extends in a lengthwise direction of the ink reservoir, and wherein the ink reservoir comprises a plurality of section units to respectively store predetermined colors of ink therein, the heater being disposed between the section units.

5. The printer according to claim 4, wherein the print head receives external information about predetermined original images, and ejects the liquid ink in accordance with the information.

6. The printer according to claim 5, wherein the length of the print head is substantially equal to a width of paper toward which the print head ejects the ink.

7. The printer according to claim 4, further comprising ink inserting orifices through which the ink reservoir provides the liquid ink to the print head, wherein the ink inserting orifices are arranged in the print head along a lengthwise direction of the print head.

8. The printer according to claim 7, further comprising an ink supplying unit to supply liquid ink to the ink reservoir, the ink supplying unit including a solid ink storage unit to store solid ink therein and a heating unit to melt the solid ink.

9. The printer according to claim 8, wherein the solid ink storage unit stores a monochromatic solid ink therein to be melted and supplied to the ink reservoir and/or a plurality of colors of ink therein to be melted and supplied to the ink reservoir.

10. The printer according to claim 9, wherein, where the ink supplying unit supplies the melted monochromatic ink, the ink reservoir comprises a section unit to store the melted monochromatic ink, and, where the ink supplying unit supplies the melted colored ink, the ink reservoir comprises a plurality of section units to respectively store the colored ink.

11. The printer according to claim 10, further comprising an ink supplying pipe to allow for a communication of melted ink between the section unit of the ink reservoir and the ink inserting orifices.

12. The printer according to claim 10, further comprising a plurality of ink supplying pipes to allow for a communication of melted ink between the plurality of section units of the ink reservoir and the ink inserting orifices.

13. The printer according to claim 4, wherein, as a temperature surrounding the ink reservoir drops below the melting point of the liquid ink, the liquid ink is prevented from solidifying due to heat.

14. The printer according to claim 4, wherein the liquid ink is stored along the lengthwise direction of the ink reservoir, such that a heat transmission rate between the heater and the liquid ink is maximized.

15. The printer according to claim 14, wherein the heater is disposed in a middle of the ink reservoir to be surrounded by the liquid ink.

16. The printer according to claim 15, further comprising a frame unit having a heater supporting hole therein to support the heater in the ink reservoir.

17. A printer, comprising a print head, to print images onto printing paper by ejecting liquid ink towards the printing paper, the print head having a length corresponding to a width of the printing paper;

an ink reservoir, having a width and a length, to store the liquid ink, the ink reservoir having a length corresponding to the length of the print head so as to provide the liquid ink to the print head along the entire length of the print head; and a heater to maintain a substantially uniform temperature of the liquid ink above a melting point thereof along substantially the entire length of the ink reservoir, wherein the heater extends in a lengthwise direction of the ink reservoir, wherein the ink reservoir comprises a plurality of section units to respectively store predetermined colors of ink therein, the heater being disposed between the section units.

* * * * *

UNITED STATES PATENT AND TRADEMARK OFFICE

CERTIFICATE OF CORRECTION

PATENT NO. : 7,654,639 B2
APPLICATION NO. : 11/418184
DATED : February 2, 2010
INVENTOR(S) : Jeong-yeon Park et al.

It is certified that error appears in the above-identified patent and that said Letters Patent is hereby corrected as shown below:

Column 7, Line 11, change "comprising" to --comprising:--.

Signed and Sealed this

Fifteenth Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,654,639 B2
APPLICATION NO. : 11/418184
DATED : February 2, 2010
INVENTOR(S) : Park et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 789 days.

Signed and Sealed this

Twenty-eighth Day of December, 2010

David J. Kappos

David J. Kappos
*Director of the United States Patent and Trademark Office*